US007629934B2

(12) United States Patent
Rhodes et al.

(10) Patent No.: US 7,629,934 B2
(45) Date of Patent: Dec. 8, 2009

(54) WEARABLE ANTENNA

(75) Inventors: Mark Rhodes, West Lothian (GB); Brendan Hyland, Edinburgh (GB)

(73) Assignee: Wireless Fibre Systems, Livingston (GB)

( * ) Notice: Subject to any disclaimer, the term of this patent is extended or adjusted under 35 U.S.C. 154(b) by 0 days.

(21) Appl. No.: 12/112,298

(22) Filed: Apr. 30, 2008

(65) Prior Publication Data

US 2009/0160716 A1 Jun. 25, 2009

(30) Foreign Application Priority Data

Dec. 19, 2007 (GB) ..... 0724705.9

(51) Int. Cl.
*H01Q 1/12* (2006.01)

(52) U.S. Cl. ..... 343/718; 343/741; 343/742

(58) Field of Classification Search ..... 343/718, 343/741, 742, 866, 867
See application file for complete search history.

(56) References Cited

U.S. PATENT DOCUMENTS 2,070,112 A * 2/1937 Bowles ..... 455/347
2,299,058 A * 10/1942 Mitchell ..... 455/157.1
3,112,447 A * 11/1963 Davis ..... 455/99
4,879,755 A * 11/1989 Stolarczyk et al. ..... 725/41
5,459,451 A * 10/1995 Crossfield et al. ..... 340/572.7
7,002,526 B1 * 2/2006 Adams et al. ..... 343/718

FOREIGN PATENT DOCUMENTS

| | | |
|---|---|---|
| DE | 20318343 | 11/2003 |
| DE | 202006006921 | 4/2006 |
| EP | 0292950 | 11/1988 |
| EP | 1393643 | 3/2004 |
| GB | 2126845 | 3/1984 |
| JP | 2009/041497 | 4/2009 |

* cited by examiner

*Primary Examiner*—Tho G Phan
(74) *Attorney, Agent, or Firm*—Paul Davis; Goodwin Procter LLP

(57) ABSTRACT

A wearable article of clothing and the like is configured to be worn by a person underwater or underground; An antenna with at least one loop, is coupled to the wearable item. The antenna provides transmission or receipt of electromagnetic signals and has a size and geometry that maximizes antenna transmission area while minimizing a restriction on movement by the person wearing the wearable article. The antenna carries an alternating current that provides conductive attenuation and has three different field components. Each field component has a different geometric loss when moving a distance r from the antenna. R is a propagating distance from the antenna.

32 Claims, 6 Drawing Sheets

WEARABLE ANTENNA

CROSS-REFERENCE TO RELATED APPLICATIONS

This application claims the benefit of UK application GB0724705.9 filed Dec. 19, 2007 and U.S. Ser. No. 61/014,800 filed Dec. 19, 2007, both of which applications are incorporated herein by reference.

BACKGROUND OF THE INVENTION

1. Field of the Invention

The present invention relates generally to magnetic loop antennas, and more particularly to the integration of loop antennas at or within a wearer's clothing.

2. Description of the Related Art

Magnetic loop antennas have a number of applications, including incorporation as part of transmitting systems, and are particularly applicable to methods of communication underwater using electromagnetic and/or magneto-inductive means. Because water, especially seawater, is partially conductive, relatively low signal frequencies are commonly employed in communication systems underwater in order to reduce signal attenuation. To this end, antennas in many applications are generally formed of conducting loops.

Such magnetic loops generate an alternating magnetic field whose strength is commonly defined by the well-understood term, magnetic moment. For signal detection at greatest distance, the largest achievable magnetic moment is desirable. The magnetic moment is directly proportional to each of the three parameters: loop area, loop current, and number of loop turns. Equivalently, it may be stated that the magnetic moment is proportional to both the ampere-turn product of the loop and to the enclosed area of the loop.

The number of loop turns and current are restricted in practice by the driving circuit and the available power supply. It is beneficial to maximise the area enclosed by the loop but a physically large structure will severely impede a wearer's movement. This limitation has been one of the factors restricting the adoption of low frequency radio communications by wearers.

SUMMARY OF THE INVENTION

Accordingly, an object of the present invention is to provide for the integration of one or more loop antennas with a wearer's clothing.

Another object of the present invention is to provide a loop antenna system as an independent item of a wearer's attire.

Yet another object of the present invention is to provide a wearable item, including but not limited to an item of clothing, including at least one loop antenna for transmitting and/or receiving electromagnetic signals, with the antenna being operable underwater, water or underground.

These and other objects of the present invention are provided in a wearable article configured to be worn by a person underwater or underground; An antenna. with at least one loop, is coupled to the wearable item. The antenna provides transmission or receipt of electromagnetic signals and has a size and geometry that maximizes antenna transmission area while minimizing a restriction on movement by the person wearing the wearable article. The antenna carries an alternating current that provides conductive attenuation and has three different field components. Each field component has a different geometric loss when moving a distance r from the antenna. R is a propagating distance from the antenna.

DETAILED DESCRIPTION OF THE PREFERRED EMBODIMENTS

In one embodiment, the present invention provides a system of magnetic and/or magneto-inductive loop antennas for use by a person underwater or underground, including but not limited to a mobile wearer. The total loop area of the antenna can be maximised while the practical motion restriction imposed on the person due to body movement is reduced and or minimized by integrating the loop antennas within the wearer's clothing. This provides a mechanism of communication that has minimal dependence on orientation of the person under water or under ground. In various embodiments, geometries of the antennas can make use of crossed loop structures to achieve a more uniform antenna field pattern as more fully described hereafter.

The wearer's freedom of movement is an important operational requirement for several reasons: safety; need to minimise the chance of snagging on external structures which could trap the wearer below the water or underground; the ability to carry out intended tasks without restricting movement and speed of movement through the water or underground; ability of the wearer to move freely such as swim freely. For these reasons it is preferable to construct an antenna system which is conformal to a the wearer's body and flexible enough to allow free movement. The antenna systems of the present invention are close to the wearer's body and implemented as an independent item of attire or integrated into clothing items, which serve a dual function, for example a dry suit or wet suit construction.

Figure 1:
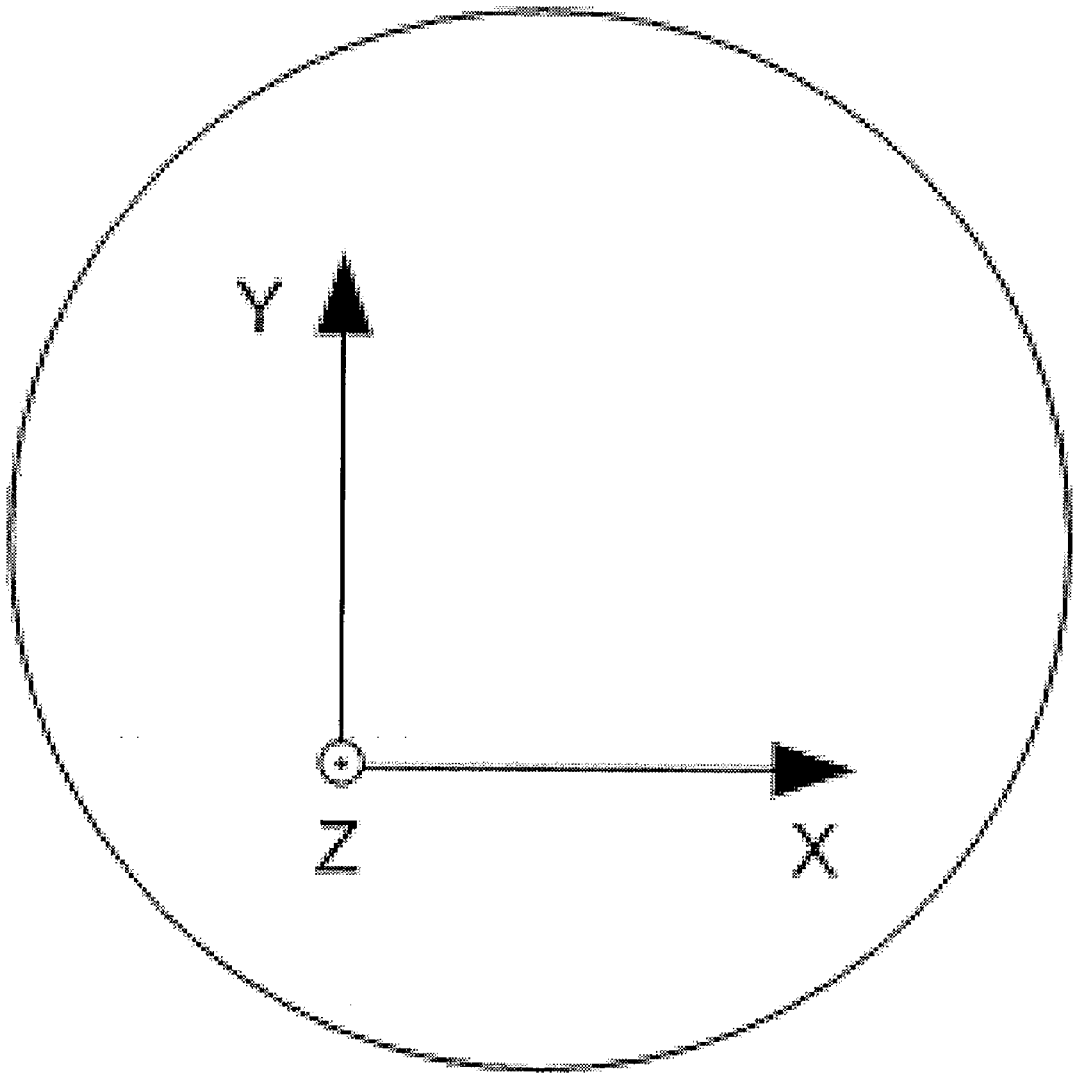
FIG. 1 illustrates one embodiment of a circular loop antenna of the present invention in the x-y plane, with the z-axis perpendicular to the loop plane.

FIG. 1 illustrates a circular loop antenna in the x-y plane with the z-axis perpendicular to the loop plane. A magnetic loop carrying an alternating current produces three distinct field components. In addition to conductive attenuation, each term has a different geometric loss as we move distance r from the launching loop. An inductive component includes a term that varies as $1/r^3$, a quasi-static term by $1/r^2$ and a propagating wave by 1/r. All these terms can be employed in a radio communications link but have different field patterns with respect to the loop. While the radiating 1/r term is most efficiently coupled between two loops arranged in the same plane, the $1/r^3$ term couples strongly when two loops are arranged coaxially in parallel planes. Although the inductive term dominates at short range it dissipates as $1/r^3$ so the radiating term dominates at the limit of range. Different orientations of the wearer loop are optimal dependant upon range and the characteristics of the communicating antenna. For these reasons it is beneficial to arrange multiple loops with diverse orientation to allow combination of signals from multiple loops or selection of a single optimal loop orientation.

Figure 2:
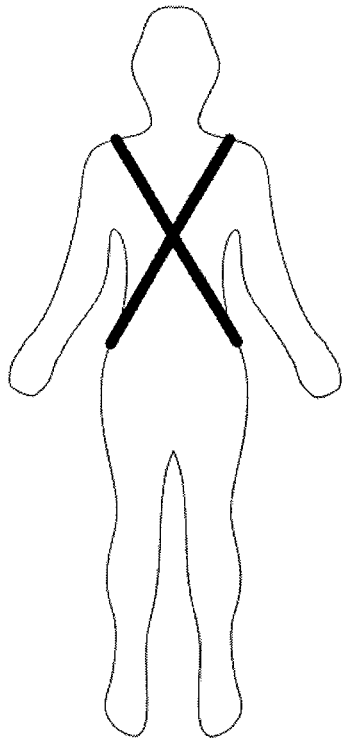
FIG. 2 illustrates an embodiment of the present invention with a crossed double loop antenna structure encompassing a wearer's torso.
Figure 3:
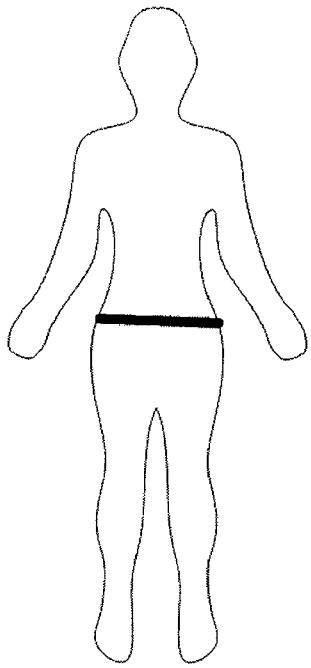
FIG. 3 illustrates one embodiment of a loop antenna of the present invention that is worn around a wearer's waist.
Figure 4:
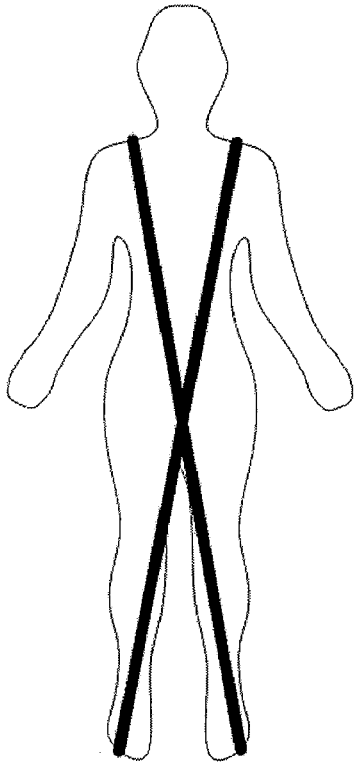
FIG. 4 illustrates one embodiment of a crossed loop structure of the present invention deployed from a shoulder to an opposite foot of a person.
Figure 5:
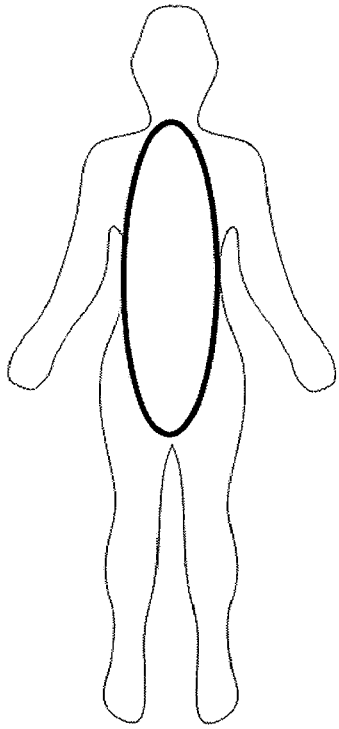
FIG. 5 illustrates one embodiment of a loop antenna of the present invention that is arranged to encompass a maximal area of a person's torso.

FIG. 2 illustrates a crossed double loop antenna structure encompassing a wearer's torso; this arrangement provides orientation diversity while making good use of the largest volume of the body to maximise enclosed loop area. FIG. 3 illustrates a loop antenna worn around a wearer's waist; this belt arrangement is the least restrictive position in the body and is beneficial if a relatively inflexible loop is required. FIG. 4 illustrates a crossed loop structure deployed from shoulder to foot; this arrangement increases loop enclosed area but practically would need to be integrated within a one-piece diving suit typical of "dry suit" designs. FIG. 5 illustrates a loop antenna arranged to encompass maximal area of the torso. This loop can be worn on the chest, back or a combined antenna system making use of both.

Figure 6:
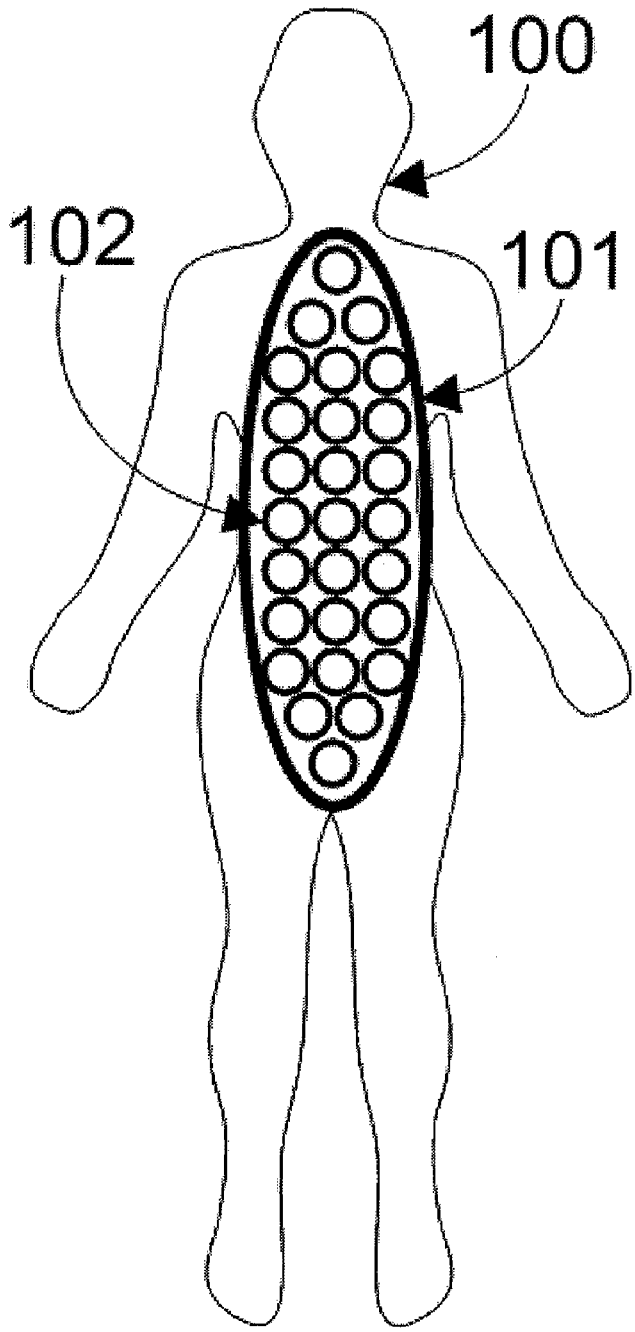
FIG. 6 illustrates one embodiment of an array of the present invention that is formed of smaller loops.

FIG. 6 illustrates an array of smaller loops 102 deployed side-by-side on a wearer's 100 chest and/or back, and a single larger loop 101 also deployed on a wearer's 100 chest or back. The item of FIG. 6 may use the antenna arrangement described in co-pending patent application "Antenna formed of multiple planar arrayed loops", GB0724704.2, the contents of which are incorporated herein by reference. In this embodiment, multiple separate conducting loops are used so that larger magnetic moments can be achieved without requiring greater drive voltage. The area available for the antenna is occupied by a number of smaller loops deployed side by side in a common plane. The magnetic moment of these sub-loops has a combined effect, which is equivalent to a single large loop with an area equal to the combined sub-loops. The drive amplifier requirement for each sub-loop is more manageable compared to a single amplifier designed to drive a larger single loop. This type of antenna system will be referred to as "planar arrayed loops".

Figure 7:
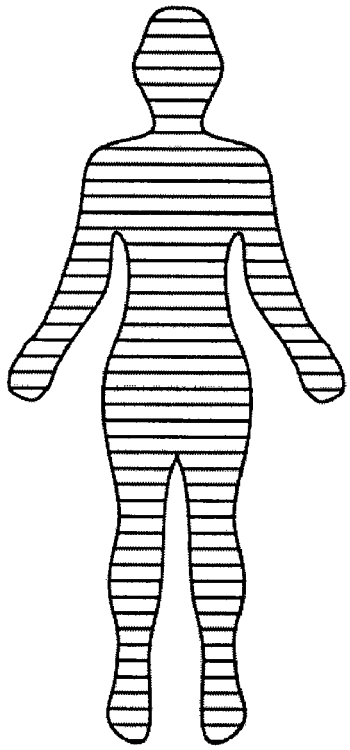
FIG. 7 illustrates one embodiment of the present invention with multiple loops wound horizontally around the body of a person.

As illustrated in FIG. 7, multiple loops can be wound around the body with their plains parallel and spaced along the symmetrical axis of the body; these can be arranged as multiple independently wound loops each with independent driving circuitry or alternatively as a common solenoid winding. In FIG. 7, the multiple antennas include sections around the arms and legs, which will typically be angularly displaced from the axis of the loops that are deployed around the torso.

The item of clothing of FIG. 7 may use the antenna arrangement that is described in co-pending patent application "Antenna formed of multiple loops", GB0724697.8, the contents of which are incorporated herein by reference. This uses an antenna construction formed of multiple separate conducting loops so that larger magnetic moments may be achieved without requiring greater drive voltage. A multi-turn loop is desirable to achieve a large magnetic moment but presents the difficulty of driving a large current through a high inductance. In this implementation a multi-turn loop is split into several sub-loops, in parallel planes and arranged around a common centre point. Sub-loops share part of the flux generated by the others but the total inductance is divided among the sub-loops. Each sub-loop has a separate drive amplifier, which only has to develop the driving voltage required to produce the desired current through a fraction of the total inductance. This type of antenna system will be referred to as "stacked multiple loops".

Figure 8:
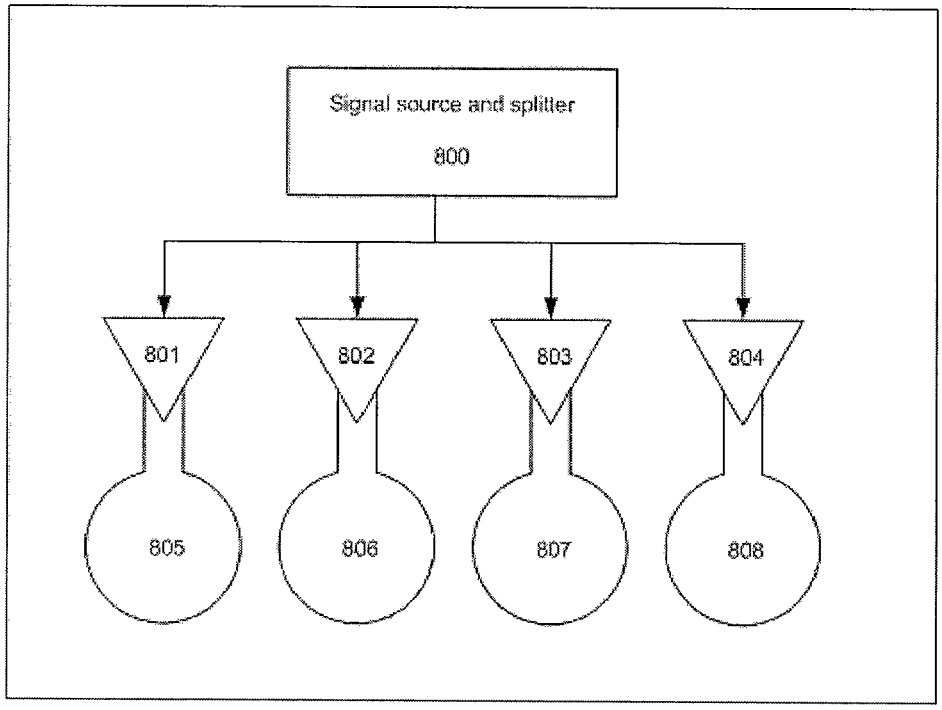
FIG. 8 illustrates one embodiment of a block diagram for a transmitter of the present invention that feeds a multiple antenna system.

Referring now to FIG. 8, a system of multiple antennas 805, 806, 807 and 808 are provided with each being driven by a separate driver amplifier 801, 802, 803 and 804. A common signal source is divided by splitter 800 with a controlled phase relationship to feed each transmit amplifier. This system can be used to drive any of the multiple antenna systems described in this application.

Figure 9:
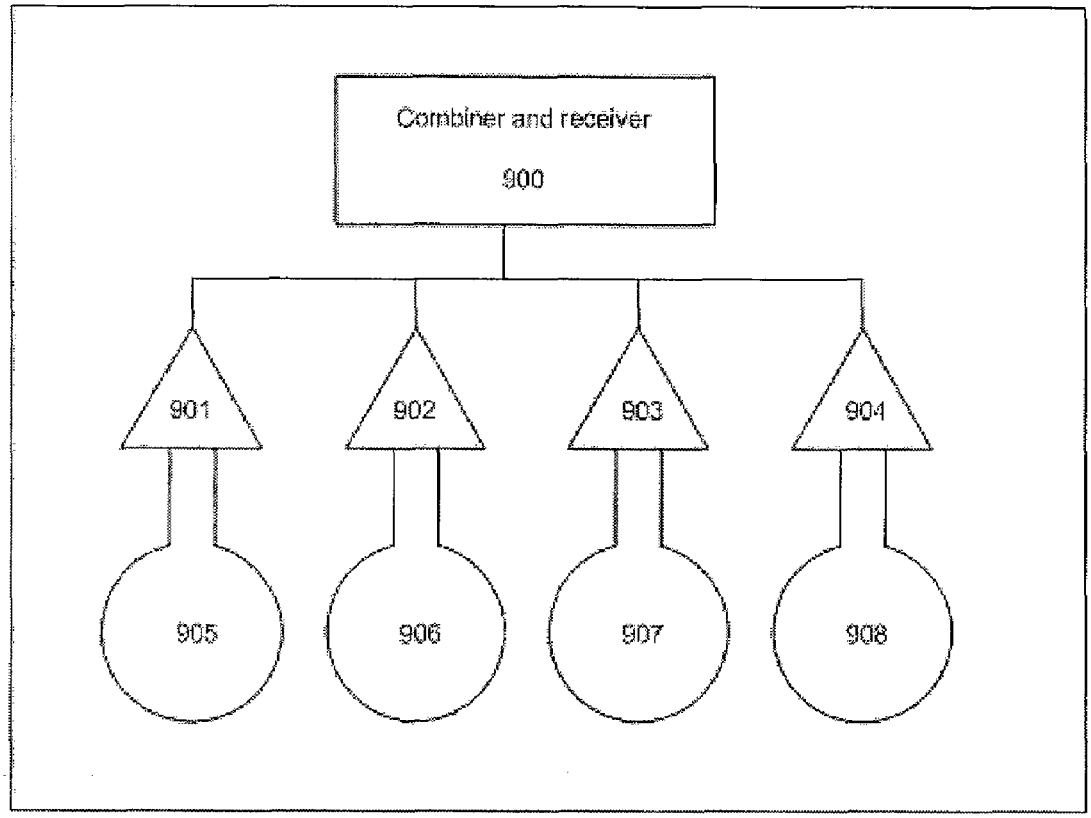
FIG. 9 illustrates one embodiment of a block diagram for a receiver of the present invention that combines signals from a multiple antenna system.

As illustrated in FIG. 9, a system of multiple antennas 905, 906, 907 and 908 is provided with each antenna connected to a receive amplifier 901, 902, 903 and 904. The receive amplifier outputs are combined with a controlled phase relationship by the combiner and receiver 900. This system can be used to combine the received signals from any of the multiple antenna systems described in this application.

Combining multiple antennas improves tolerance to failure compared to a single continuous multi-turn solenoid winding of the equivalent number of turns, which will fail if the single wire breaks at any point along its length. While the transmitter and receiver systems are illustrated separately, in practice common antennas may be used that are switched between transmit and receive functions.

One beneficial property of submerged radio communications is the signal's ability to cross the water to air boundary. The antenna system of the present invention can be operational in air to provide communication by a wearer on the surface to submerged team members.

Integrated wearable loop antennas of the present invention are particularly advantageous for use in low frequency radio communications. Radio signals are attenuated by transmission through water due to its partially conductive nature and attenuation increases as a function of frequency. Radio transmissions through the ground are also attenuated by the partial conductivity of the geological materials and low frequency radio signal are also beneficial for underground applications. The wearable antenna structures described herein are suitable for underground and underwater deployments.

A skilled person will appreciate that variations in implementation and application of the disclosed example arrangements are possible without departing from the essence of this invention, and variations may still derive full or partial advantage from it. For example, each of the individual loops illustrated may be constructed from a single turn of electrically conducting cable or alternatively may be formed from many turns. Also, whilst FIG. 2 to 7 show various loop arrangements separately, any two of more of these could be used in combination. Furthermore, in those applications of this transmitting antenna, which also require a receiving function, the antenna loops also may be used conveniently and advantageously as an electromagnetic or magneto-electric receive antenna. Applications of this invention are not limited to communication systems but may also include others, which require a large alternating magnetic moment. These include but are not limited to navigation systems, direction finding systems and systems for detecting the presence of objects.

While the invention has been described and illustrated with reference to certain particular embodiments thereof, those skilled in the art will appreciate that various adaptations, changes, modifications, substitutions, deletions, or additions of procedures and protocols may be made without departing from the spirit and scope of the invention. For example, the positioning of the LCD screen for the human interface may be varied so as to provide the best location for ergonomic use. The human interface may be a voice system that uses words to describe status or alarms related to device usage. Expected variations or differences in the results are contemplated in accordance with the objects and practices of the present invention. It is intended, therefore, that the invention be defined by the scope of the claims which follow and that such claims be interpreted as broadly as is reasonable.

What is claimed is:

1. A wearable article configured to be worn by a person underwater or underground; an antenna with at least one loop, the antenna coupled to the wearable item that provides at least one of, transmission and receipt of electromagnetic signals, the antenna having a size and geometry that maximizes antenna transmission area while minimizing a restriction on movement by the person while wearing the wearable article, the antenna being configured to carry an alternating current that provides a field having conductive attenuation and which has three different field components, each of said field components having a different geometric loss moving a distance r from the antenna, where r is a propagating distance from the antenna wherein said three different field components are, an inductive component with a term that varies as $1/r^3$, a quasi static term by $1/r^2$ and a propagating wave term by 1/r.

2. The wearable communication device of claim 1, wherein the different field components have different field patterns with respect to the at least one magnetic loop.

3. The wearable communication device of claim 1, wherein said 1/r term provides for coupling between two loop antennas are arranged in a same plane.

4. The wearable communication device of claim 1, wherein the $1/r^3$ term couples when two loop antenna are arranged coaxially in parallel planes.

5. The wearable communication device of claim 1, wherein the inductive term dominates at short range and dissipates as $1/r^3$ and where the radiating term dominates at the limit of range.

6. The wearable communication device of claim 1, wherein the antenna is integrated with the wearable article.

7. The wearable communication device of claim 1, wherein the orientations of the antenna are dependent on a range of communication.

8. The wearable communication device of claim 1, wherein the antenna is positioned relative to the wearable item to reduce a dependence on the person's orientation while underwater or underground.

9. The wearable communication device of claim 1, wherein the antenna includes a plurality of loops.

10. The wearable communication device of claim 9, wherein, at least a portion of the loops have different orientations.

11. The wearable communication device of claim 10, wherein the different orientations provide for a combination of signals from the antenna or selection of a single optimal loop orientation.

12. The wearable communication device of claim 9, wherein the plurality of loops are used to provide for larger magnetic moments without requiring greater drive voltage.

13. The wearable communication device of claim 9, wherein the antenna includes a large loop and a plurality of smaller loops that are deployed side by side in a common plane.

14. The wearable communication device of claim 1, wherein the wearable article has a torso portion and at least a portion of the antenna that crosses the torso portion.

15. The wearable communication device of claim 14, wherein the antenna is a double loop antenna that crosses the torso portion.

16. The wearable communication device of claim 1, wherein at least a portion of the antenna extends around a waist portion of the person.

17. The wearable communication device of claim 1, wherein the wearable item extends from a shoulder to a first foot of the person, and the antenna is a crossed loop that extends from shoulder to an opposite second foot.

18. The wearable communication device of claim 1, wherein the antenna is a loop antenna that lies in a plane of at least one of a chest portion and a back portion of the person.

19. The wearable communication device of claim 18, wherein the antenna includes a plurality of planar antennas positionable on at least one of the chest portion and the back portion of the person.

20. The wearable communication device of claim 18, wherein the antenna includes a plurality of antennas in a planar array on at least one of the chest and back portions of the person.

21. The wearable communication device of claim 1, wherein the loop antenna has at least one turn wound around a portion of the person.

22. The wearable communication device of claim 1, wherein the antenna has a plurality of loops, and at least a portion of the plurality of loops are independently wound.

23. The wearable communication device of claim 22, wherein at least a portion of the plurality of loops have a separate transmitter for transmitting signals.

24. The wearable communication device of claim 23, wherein each of said transmitters transmits signals from a common source.

25. The wearable communication device of claim 22, wherein at least a portion of the plurality of loops have separate receivers for receiving signals.

26. The wearable communication device of claim 25, wherein signals received from each loop are combined in a receiver system.

27. The wearable communication device of claim 26, wherein each of a loop of the plurality of loops is substantially parallel to the other loops.

28. The wearable communication device of claim 1, wherein the loop has multiple turns formed from a single wire.

29. The wearable communication device of claim 1, wherein the wearable article includes at least one of, a body portion; one or more arms one or more legs and a torso portion.

30. The wearable communication device of claim 29, wherein the wearable item is a full body suit.

31. The wearable communication device of claim 30, wherein the full body suit is a dry or wet dive suit.

32. The wearable communication device of claim 1, wherein the wearable article is a item that is an over garment to be worn over other garments.

* * * * *